US008445821B2

(12) United States Patent
Iwamoto

(10) Patent No.: US 8,445,821 B2
(45) Date of Patent: May 21, 2013

(54) BUILT-IN COOKING DEVICE

(75) Inventor: Masayuki Iwamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 547 days.

(21) Appl. No.: 12/700,326

(22) Filed: Feb. 4, 2010

(65) Prior Publication Data

US 2010/0200577 A1 Aug. 12, 2010

(30) Foreign Application Priority Data

Feb. 6, 2009 (JP) ..... 2009-025812

(51) Int. Cl.
*H05B 6/64* (2006.01)
*F24C 7/02* (2006.01)

(52) U.S. Cl.
USPC ..... 219/757; 126/198; 219/756

(58) Field of Classification Search
None
See application file for complete search history.

(56) References Cited

U.S. PATENT DOCUMENTS

2008/0105140 A1* 5/2008 Lee et al. ..... 99/468
2008/0264933 A1* 10/2008 Jeong ..... 219/679

FOREIGN PATENT DOCUMENTS

JP 6-82046 A 3/1994
JP 9-229377 A 9/1997
JP 2002-228163 A 8/2002
JP 2005-3316 A 1/2005
JP 2005-221081 A 8/2005
JP 2006-223337 A 8/2006

* cited by examiner

*Primary Examiner* — Johannes P Mondt
(74) *Attorney, Agent, or Firm* — Birch, Stewart, Kolasch & Birch, LLP

(57) ABSTRACT

The invention provides a built-in cooking device comprising a door 2*a* having a size large enough to cover the front side of a cooking device body including a lower portion thereof, and on an inner lower surface of the door 2*a* facing the lower portion of the cooking device body is formed an air inlet portion 15*a* and an air outlet portion 15*b* composed of an air guide portion having a recessed portion for the air inlet and outlet portions, by which directions of the inlet air and outlet air moving in forward and rearward directions along the recessed portion of the door 2*a* are changed to the perpendicular direction. The present device has eliminated the front-side air inlet and outlet using an air inlet and outlet grill using an inlet and outlet air blow duct layer structure disposed on the bottom side of the device, and the rear side of a duct constituting the present air inlet and outlet portion is disposed along a warm wall surface of the heating chamber.

4 Claims, 3 Drawing Sheets

BUILT-IN COOKING DEVICE

The present application is based on and claims priority of Japanese patent application No. 2009-025812 filed on Feb. 6, 2009, the entire contents of which are hereby incorporated by reference.

BACKGROUND OF THE INVENTION

1. Field of the Invention

The present invention relates to cooking devices in general, and especially relates to built-in cooking devices such as microwave ovens built into furniture and cabinets.

2. Description of the Related Art

A large number of cooking devices such as microwave ovens with an open/close door disposed on a front side thereof have been proposed, but on the other hand, another type of cooking devices having a drawer integrally formed with a door that can be drawn out to the front side of the device has also been proposed. The drawer type cooking devices can suitably be applied to relatively large-scale structures, so that they are considered as cooking devices constituting a portion of fitted kitchen or designed kitchens. Reflecting the recent systemization and increase in size of kitchens, cooking devices have also been diversified and unitized, and various cooking devices being combined with cook tops, drawer-type microwave ovens, electric ovens and so on and built into kitchens are provided. Built-in cooking devices are suitably applied to kitchen structures where a large number of cooking equipment are arranged three-dimensionally, since built-in devices can be built into areas below the counter top of the kitchen so as not to occupy the space above the countertop. Therefore, drawer type cooking devices are considered as one type of cooking apparatuses that constitute fitted kitchens or designed kitchens, and the use of such drawer type kitchen devices is expanding recently especially in the United States.

The present applicant has proposed a drawer type microwave oven which is a type of a drawer type cooking device, wherein the microwave oven comprises a cooking device body including a heating chamber, a drawer body disposed movably within the cooking device body so as to be drawn out from within the heating chamber of the cooking device body, and a slide mechanism for moving the drawer body within the cooking device body, wherein the slide mechanism is disposed outside the heating chamber, so as to enable the slide mechanism to be formed without using members or materials having high heat resistance and flame resistance, and to prevent the occurrence of discharge failure caused by microwave (patent document 1: Japanese patent application laid-open publication No. 2005-221081). According to the drawer type cooking device, the loading portion for loading the object to be heated in the heating chamber can be drawn out together with the door, so as to eliminate the need to form the slide mechanisms using components or materials having high heat resistance and flame resistance, and to prevent the occurrence of microwave discharge failure caused by microwave.

Traditional cooking devices on countertop are almost without exception supplied with air inlet and outlet over back panel and side panels of the outer cabinet, taking in air through air inlet for the purpose of cooling electrical components and others, and discharging through air outlet hot air with vapor emitting from foods cooked to be scattered into the thin kitchen air. Such configuration in design to place such air inlet and outlet over insignificant areas of the cabinet to counterpart inner configurations requires only ordinary engineering skills and practices.

On the other hand, built-in cooking devices, especially such as shown in the present applicant's patent document 1 above, are allowed to take in and discharge air only by way of limited square inches that could be spared apparently on the front surface, forcing severe restrictions on specialists in the trade to decide upon cooking device configurations. Based on such restrictions arising from majoring in built-in construction, the present applicant has proposed a drawer type cooking device as a built-in kitchen equipment to be built into a cabinet, wherein an air inlet portion and an air outlet portion are collectively disposed on a lower end portion on the front side of the device to thereby improve the efficiency of intake and discharge of air, improve the efficiency of cooling electric components and discharge of inside air, and to relieve the limitations of design and arrangement of the cooking device (patent document 2: Japanese patent application laid-open publication No. 2006-223337).

The concept of air flow according to the air inlet and outlet system according to the above-mentioned drawer type cooking device is as illustrated in FIG. 5. Further, FIGS. 6A and 6B show the arrangement of electric components at a depth portion of the prior art built-in cooking device, wherein FIG. 6A is a right side view and FIG. 6B is a rear view thereof. A louver of the air inlet and outlet grill is disposed to cover the whole width of the cooking device body 51 at the lower front side portion of the cooking device body 51, wherein the left end portion of the front side air inlet and outlet grill is formed as an air inlet port 63. A lower side portion 59 arranged below the heating, chamber 53 of the cooking device body 51 constitutes a bottom surface air inlet and outlet duct structure, wherein the left end portion of the bottom surface air inlet and outlet duct corresponding to the front side air inlet port 63 is formed as an air inlet portion 60. When a cooling fan 56 within the electric component chamber disposed at a rear portion of the cooking device body 51 is activated, cooling air F1 is taken in via the front side air inlet port 63 through the air inlet portion 60, reaches a depth portion chamber at a rear side of a depth wall of the heating chamber 53 of the cooking device body 1, and is further blown into the interior of the cooking device body 51 by the cooling fan 56. In other words, the built-in drawer type cooking device has a front-side concentrated air inlet and outlet grill, and an inlet and outlet air blow duct layer structure formed on the bottom side thereof.

One portion of the blow out air flow (air flow F3) from the cooling fan cools an electric component (magnetron 54), and then flows through an opening portion formed on the depth wall surface of the heating chamber 53 into the heating chamber 53 (F5), passes the interior of the heating chamber 53, and then flows through an opening portion disposed on the front side of the heating chamber into a ceiling panel air outlet duct 66 (F6). The ceiling panel air outlet duct 66 is laid horizontally toward the depth of the product on the outer side of the ceiling panel of the heating chamber (first portion 66*a*), and at the portion where the heating chamber ceiling panel is ended, it is bent toward the right and laid horizontally (second portion 66*b*), and then at the right end of the heating chamber, it is laid to bend down perpendicularly to enable air to flow into a vertical duct 67 disposed on the right end (F7 through F9). The discharged air is finally passed through an air outlet duct 61 on the right end of the bottom surface air inlet and outlet duct, and blows out to the exterior through the right end air outlet port 64 of the front side air inlet and outlet grill (F10, F11). The other air flow F4 from the cooling fan cools the electric component (high pressure transformer 55) disposed within the electric component chamber (F12), passes through the air outlet duct 62 disposed at the center of the bottom surface air inlet and outlet duct, and is discharged to the exterior through the center air outlet port 65 of the front inlet and outlet grill (F13, F14). As described, the air outlet duct 61 through which hot air containing vapor from the heating chamber 53 passes is distanced from the air inlet duct 60 through which cool air passes, according to which dew condensation caused by cooling of hot air can be prevented.

It is essentially rational to discharge the hot outlet air flow from the upper area of the cooking device, but since the air will be discharged toward the user, such arrangement cannot be adopted in practice. Further, if the air is discharged through a louver disposed on the lower portion of the cooking device, the hot outlet air flow will be blown out toward the user's legs. Therefore, the prior art drawer type cooking device proposes an arrangement in which an air outlet duct with a louver independently from the door is disposed, which requires an independent area for inlet air and outlet air to be formed within the limited height of the device.

However, according to the above-mentioned drawer type cooking device, the air outlet path becomes long, and the duct structure, especially the duct structure passing through the interior of the heating chamber, becomes complex and the flow path resistance (pressure loss caused by duct resistance) is increased. As a result, a cooling fan having a high air blow performance is required, by which the product costs and operation costs of the cooling fan are increased. Further, in order to push out the air from within the heating chamber, the pressure within the heating chambers turns to high static pressure, so that vapor may easily leak through the clearance formed at the door from within the heating chamber. If the prevention of microwave leakages is highly prioritized, vapor leak may occur from the very fine clearances between the welded portions of the door, causing dew condensation. Since the duct also has may joints, vapor may leak through the joints and cause dew condensation. Further, built-in devices must be placed in limited setting spaces having restricted heights, but since the lower duct and the louver portion take up a certain height, the height for ensuring independent inlet and outlet area had to be sacrificed and taken from the inner space of the cooking device.

As described, according to the built-in drawer type cooking device with a front-side concentrated air inlet and outlet structure, the inlet and outlet air blow duct layer structure is formed on the bottom side of the device, so that the air blow path becomes long, leading to problems such as increase of fan load, deterioration of space utilization efficiency, and reduction of vertical compressive strength caused by the duct (damage caused by impact during shipping of product). Moreover, the air inlet and outlet grill disposed on the lower side of the front surface of the device deteriorates the front side design of the device. Furthermore, according to this arrangement, it is difficult to prevent short circuit of the inlet and outlet air, that is, to prevent the high-temperature outlet air from mixing with the inlet cool air flowing adjacent to the outlet air, according to which the inlet air temperature becomes higher than room temperature.

Patent document 3 (Japanese patent application laid-open publication No. 2002-228163) discloses an attachment panel for a cooking device, comprising forming air blow spaces on the upper portion and the lower portion of the microwave oven being built into a closed space in a furniture instead of being placed in the open space on a counter top, forming an air inlet and outlet opening on a front side of the air blow space, and using a build-in kit for taking in air from and discharging air into the closed space, wherein the air discharged from the lower portion of the front side of the oven is directed downward so as to prevent hot air from blowing directly toward the body of the user.

If the air inlet and the air outlet of the microwave oven are separated vertically into upper and lower areas, the object of preventing hot air from blowing toward the user can be achieved simply by directing the outlet air to flow downward. However, when air is taken in and discharged from adjacent portions on the lower area on the front side, a problem occurs in which the discharged hot air is sucked in through the air inlet and causes short circuit. Therefore, it is necessary not only to improve the arrangement of the attachment panel of the cooking device but also to set the air blow speed of the outlet air, and to improve the arrangements of the inlet port and the outlet port.

The problem to be solved according to the built-in cooking device is to eliminate the inlet and outlet air blow duct layer structure formed on the bottom side of the device, and to alter the air outlet structure for discharging the inside air containing heat and vapor generated during cooking of an object to be cooked to the exterior, so as to form an air inlet and outlet structure capable of blowing air using the clearance between the warm wall surface of the heating chamber and the components disposed inside the cooking device body.

The object of the present invention is to provide a built-in cooking device in which an air outlet duct is formed along the warm wall surface of the heating chamber, to thereby prevent vapor from being cooled rapidly and causing dew condensation.

SUMMARY OF THE INVENTION

In order to solve the prior art problems mentioned above, the built-in cooing device according to the present invention comprises a cooking device body built into a cabinet and having in an interior thereof a heating chamber capable of storing an object to be cooked, a door capable of closing a front side opening of the heating chamber, and an air inlet and outlet portion having an air inlet portion for taking in cooling air to be sent into the heating chamber and an air outlet portion for discharging an inside air containing heat and vapor generated during cooking of the object to be cooked from the heating chamber, wherein the door has a size large enough to cover the front side of the cooking device body including the lower portion thereof, and has a recessed portion for the air inlet and outlet portion formed at an inner lower side portion facing the lower portion of the cooking device body, and the direction of inlet air and outlet air flowing in the forward and rearward directions through the recessed portion of the door is changed to a perpendicular direction.

The present built-in cooking device enables to eliminate the front-side air inlet and outlet using the air inlet and outlet grill through the inlet and outlet air blow duct layer structure disposed on the bottom portion of the device, and arranges the rear side of the duct constituting the air inlet and outlet portion along the warm wall portion of the heating chamber, so that the air inlet and outlet portion can be hidden via the door, and the front side design of the built-in cooking device can thereby be improved.

Further according to the built-in cooking device, a partition for separating the inlet air and outlet air can be disposed at the recessed portion formed on the inner lower side portion of the door. By arranging the partition for separating the inlet air and outlet air and improving the shape thereof, it becomes possible to prevent the occurrence of a short circuit in which the high temperature outlet air flowing through the air outlet portion is taken into the air inlet portion.

Further according to the built-in cooking device, a clearance functioning as an air outlet path for slowly releasing the air having high heat and high humidity and retained at an upper portion of the cooking device body to the exterior can be formed between an upper front end of the cooking device body and an upper portion of the door.

Even further, the built-in cooking device can comprise an air inlet wall portion having a large number of holes formed on a rear wall of the heating chamber, wherein the air having been taken in through the air inlet portion and cooling a magnetron for generating microwave for cooking can be introduced through the air inlet wall portion into the heating chamber. The air containing vapor generated in the heating chamber during cooking has high temperature and small specific gravity, so it tends to be retained at an upper portion (ceiling) of the heating chamber, but the air used to cool the magnetron enters the heating chamber and becomes an inner chamber air flow that enables the high temperature air containing vapor to flow toward the air discharge direction.

The built-in cooking device according to the present invention is arranged as above, which includes a very small amount of duct as air inlet and outlet portion, so that there is very little pressure loss, and air can be discharged without increasing the pressure within the heating chamber, and without causing vapor from leaking through clearances such as at welded portions of the door. Therefore, the present invention provides an effective countermeasure against dew condensation, and the size of the components related to the duct can be downsized. Further, since the air inlet and outlet portion is hidden by the door, and since the louver that had been disposed on the front side of the device in the prior art is eliminated, the design of the door can be improved. Furthermore, since the lower portion of the door and the cooking device body is designed as the air inlet area, the air inlet path becomes short and direct, enabling inlet air to flow through a wide area along the bottom surface of the heating chamber, and it becomes possible to realize a heat collecting effect. Furthermore, since the air outlet portion is also short and not diverted to the lower portion, the air blow resistance can be improved significantly.

As for the cooling efficiency, since the cooling air taken in through the air inlet portion is blown directly toward the electric components such as the high pressure transformer to cool the same, the cooling efficiency is improved by the increase of cooling air quantity and improved air blow method, which leads to the cutting of cost of the high pressure component and the improvement of quality. Further, since electric components are cooled by the inlet air having a temperature close to room temperature that does not have outlet air mixed thereto, the rising of temperature of electric components can be reduced and the component reliability can be improved.

Even further, the motor for automatically opening and closing the door is disposed on the bottom side of the heating chamber within the air outlet area, wherein based on temperature tests, the lower temperature reaches up to 70 to 80 degrees. According to the characteristics of the motor, the torque during opening and closing operation is lowered when temperature rises, so that the motor had to be designed assuming the temperature rise state. In contrast, according to the built-in cooking device of the present invention, a partition is disposed on a bottom surface of the heating chamber, so that half of the bottom surface corresponds to outlet air and the other half corresponds to inlet air. Thereby, the temperature of the mounting portion of the motor is substantially maintained to room temperature. According to such air inlet and outlet structure, the cooking device may be at high temperature, while the motor is at a cooled temperature.

The present built-in cooking device enables further to solve the problems of heating and moistening of the ceiling panel of the casing, leading to improved reliability, together with measures to prevent dew condensation in the interior of the device after the operation is stopped. According to the prior art, the heated air was sent downward and discharged through the front side louver, but a portion of the air is also discharged from the upper portion of the heating chamber. The clearance between the control panel disposed at the upper front end of the cooking device body and the upper portion of the door is widened (approximately by 2 mm), and a simple duct is formed between the upper surface of the door and the lower surface of the control panel.

When the temperature within the heating chamber rises by the cooking operation, the temperature of the ceiling panel also rises (sometimes even up to 70 to 80 degrees). According to the prior art built-in cooking device, no special air flow for cooling the ceiling was provided, and the heat of the ceiling panel was naturally radiated through the material of the device to the inner space within the cabinet to which the cooking device was built in. Therefore, the top surface of the casing was heated, and especially, it has been observed that the inner temperature of the operation unit disposed on the upper portion of the cooking device which had been separated from the heat on the upper portion of the ceiling panel of the heating chamber via a partition wall was heated by the heating of the top surface of the housing. On the other hand, according to the present built-in cooking device, a portion of the air having cooled the electric components disposed at the depth portion of the heating chamber is raised using the air pressure of the marginal portion of the air flow of the air blow fan, so that the air flows along the upper side of the ceiling panel to cool the same, and the air having been heated (and not containing vapor) is discharged naturally using a natural convection effect.

Such outlet air flow moderates the rising of temperature of the upper area of the cooking device and improves the reliability of the control unit, while utilizing the air pressure of the blown air flow to prevent the hot and humid air generated within the heating chamber from entering, so that both the heating and moistening of the top surface of the casing of the device can be prevented. Further, since the portion that had not been cooled by air flow according to the prior art is now cooled, so the overall cooling efficiency of the cooking device can therefore be improved.

Further according to the prior art built-in cooking device, if the layer having an air inlet and outlet structure is disposed on the lower area of the device, since the layer is not rigid, it is weak against dropping impact applied thereto during shipping, so that measures to reinforce the layer must be provided, and the arrangements and the orientations of weight components such as the high pressure transformer disposed on the layer must be determined carefully. On the other hand, the built-in cooking device according to the present invention has enabled to eliminate the lower layer structure which had been a weak point in the arrangement of the device, and air can be taken in and discharged through the clearance space formed between the components within the device, so that it has a strong structure against impact, and the arrangements and orientations of weight components can be decided as according to normal design considerations.

DETAILED DESCRIPTION OF THE PREFERRED EMBODIMENTS

Figure 1:
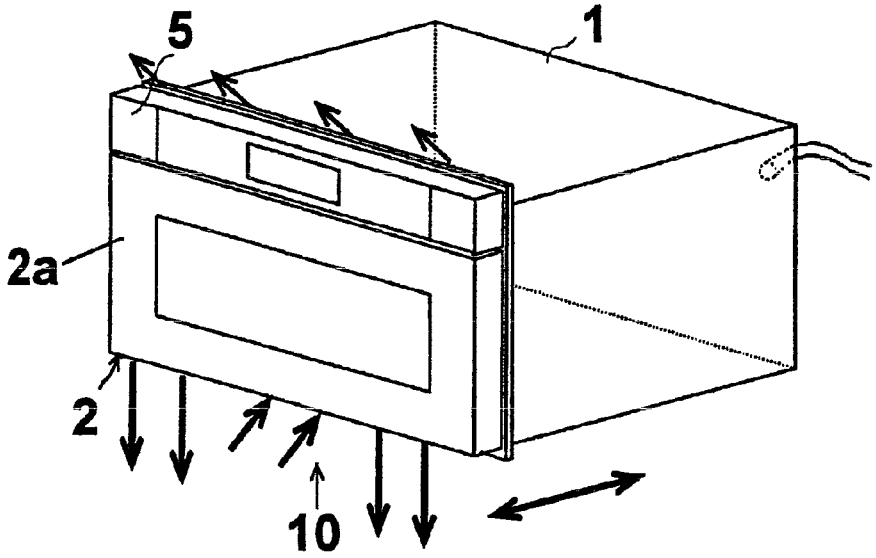
FIG. 1 is a perspective view showing the overall external appearance according to a preferred embodiment of a built-in kitchen equipment of the present invention.

Now, a preferred embodiment of a built-in cooking device according to the present invention will be described with reference to the drawings. As illustrated in FIG. 1 through FIGS. 3A and 3B, a cooking device body 1 built into a cabinet has formed in the interior thereof a heating chamber 3 for storing an object to be cooked. The object to be cooked is placed on a loading portion of a drawer body 2 capable of being drawn out of or stored into the heating chamber 3. The drawer body 2 is formed integrally with a door 2*a* capable of shutting a front side opening 3*a* of the heating chamber 3. Therefore, when the drawer body 2 is at a stored position within the heating chamber 3, the door 2*a* shuts the front side opening 3*a* of the heating chamber 3, and prevents microwave generated during the cooking operation from leaking to the exterior of the heating chamber. The drawer body 2 is guided in sliding motion with respect to the cooking device body 1 via a slide mechanism (not shown) disposed on the outer side of the heating chamber 3, which can be provided with a driving means such as an electric motor for automatically opening and closing the door, or for assisting the manual opening and closing operation of the door. In FIG. 1, the flow of inlet air and outlet air in the built-in cooking device is shown by arrows.

Figure 2:
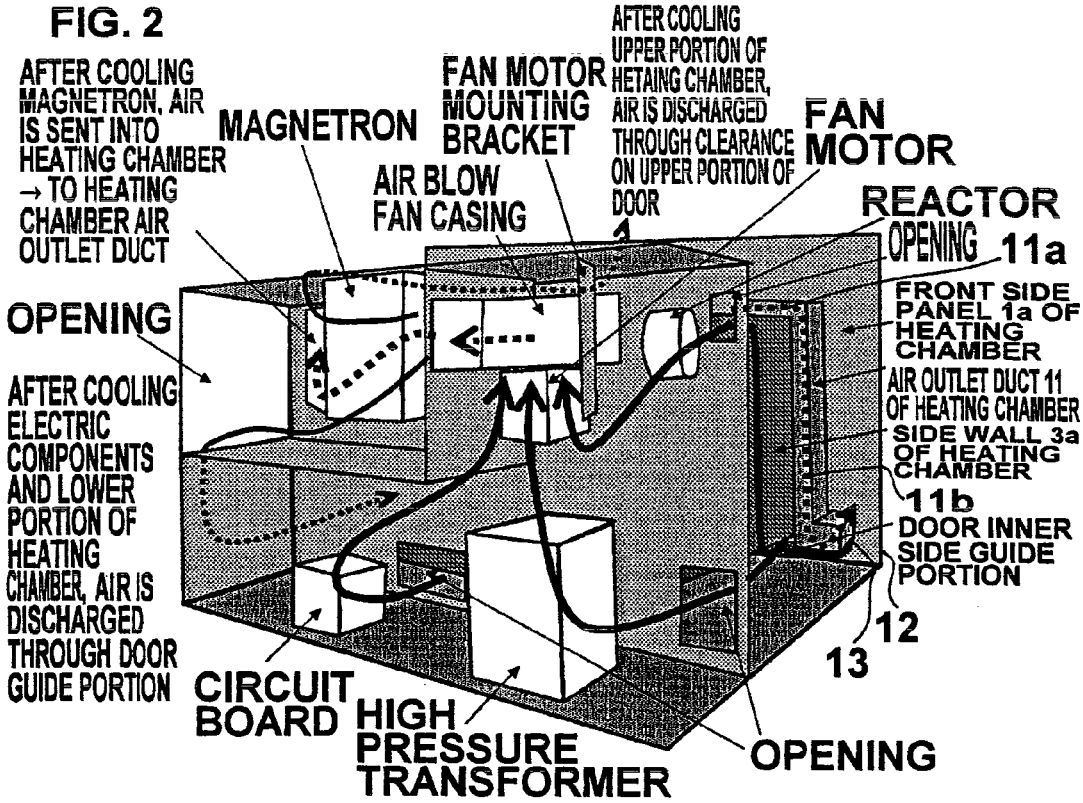
FIG. 2 is a perspective view taken from the rear right-side direction of the cooking device, illustrating the concept of the air blow path according to the present invention.
Figure 3A:
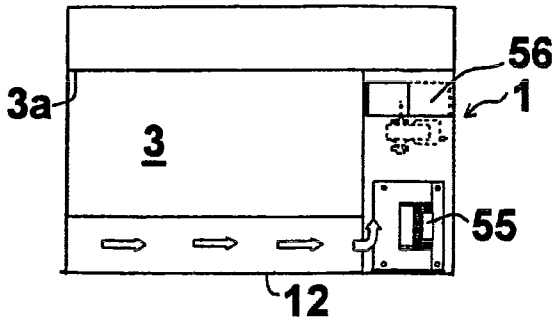
FIG. 3A is a conceptual view showing the air flow of the inlet and outlet air guide portion.
Figure 3B:
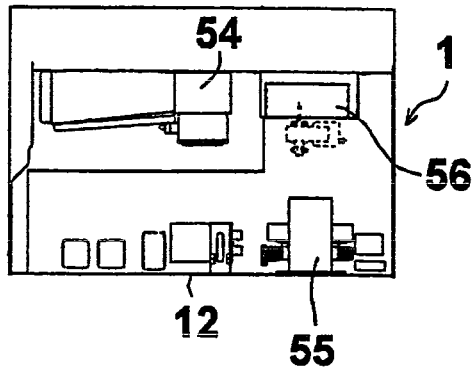
FIG. 3B is a conceptual view showing the air flow of the inlet and outlet air guide portion.
Figure 5:
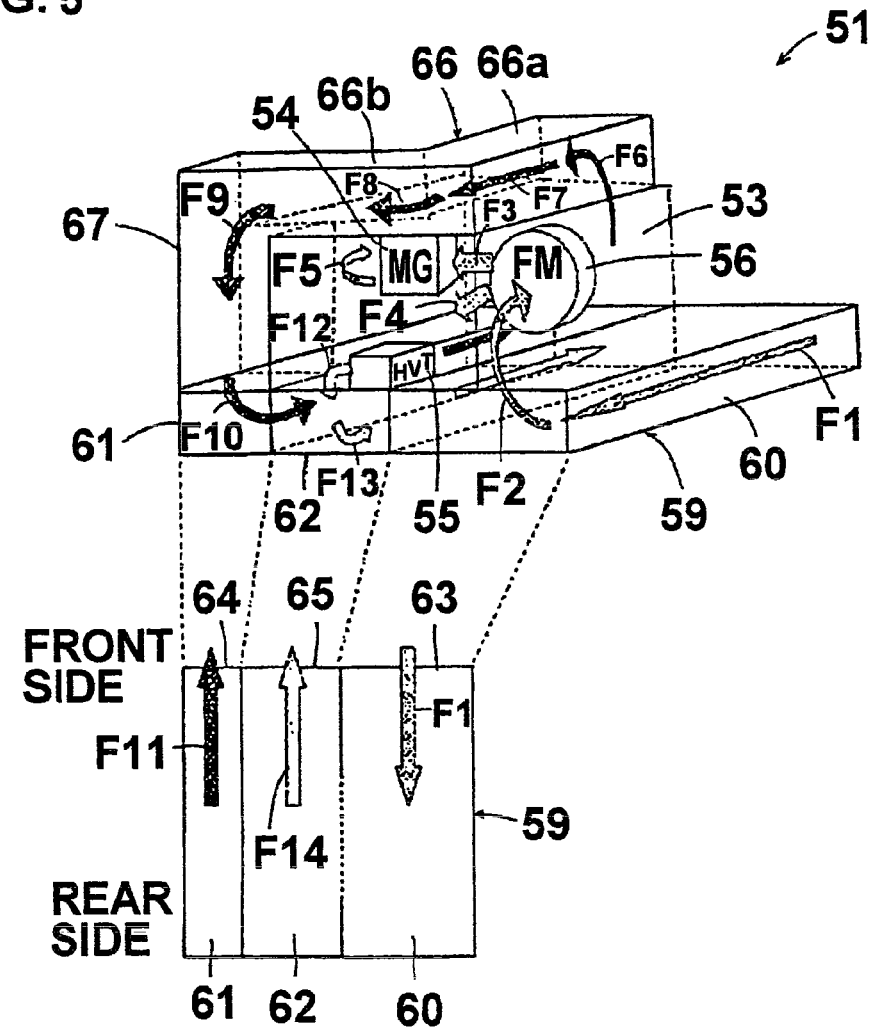
FIG. 5 is a conceptual view of an air outlet structure of the built-in cooking device according to the prior art.
Figure 6A:
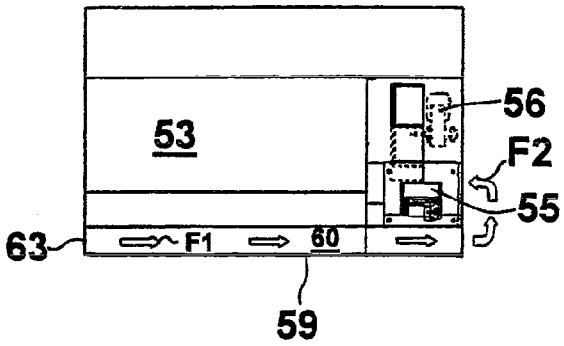
FIG. 6A is a view showing the arrangement of electric components at a depth portion of the built-in cooking device according to the prior art.
Figure 6B:
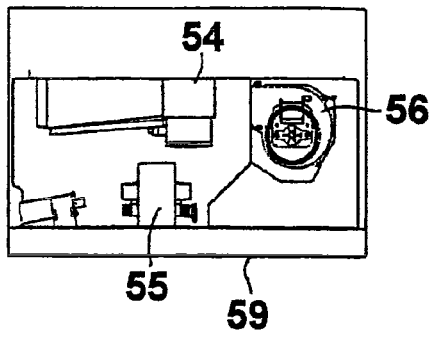
FIG. 6B is a view showing the arrangement of electric components at a depth portion of the built-in cooking device according to the prior art.

FIG. 2 shows a conceptual view of an air outlet structure of the built-in cooking device. Further, FIGS. 3A and 3B show the arrangement of electric components at the depth portion of the built-in cooking device. The components equivalent to those in the prior art air outlet structure illustrated in FIG. 5 are denoted with the same reference numbers, and detailed descriptions thereof are omitted. FIG. 2 is a conceptual view illustrates how the air taken in from the exterior is sent into the heating chamber 3 through the operation of a cooling fan 56. The air flowing in through the openings having various sizes corresponding to electric components generating high heat formed on a rear panel of the heating chamber 3 into the depth portion of the device cools the high pressure transformer 55 and the circuit board, and then is sucked through the cooling fan 56. A major portion of the air sent out from the cooling fan 56 cools a magnetron 54, flows into the heating chamber 3, and thereafter, is discharged to the exterior through a heating chamber air outlet duct 11.

Another air flow sent out from the cooling fan 56 flows through a ceiling surface air outlet duct, cools the upper portion of the heating chamber 3 (the ceiling panel and the upper area thereof), and is discharged through a clearance formed above the door. The remaining air flow cools the electric components and the lower part of the heating chamber 3, and is discharged through a door guide portion.

The magnetron 54 not only requires cooling since it is a heat generating component, but the operation characteristics of the magnetron varies greatly by temperature, so that the quantity of cooling air flow for cooling the same must be ensured stably with higher priority than for cooling other heat generating components such as the high pressure transistor. Therefore, the magnetron 54 and the cooling fan 56 are arranged closely so as not to have the cooling air flow quantity supplied to the magnetron 54 affected by the dispersion of arrangements of other electric components.

Since the inside air within the heating chamber 3 contains heat and vapor generated during cooking of the object to be cooked, an air outlet portion 10 for discharging the inside air is disposed in the cooking device body 1. The discharge of inside air is performed by increasing the inside pressure within the heating chamber 3 by sending into the heating chamber 3 the outer air taken in via the cooling fan 56 through an air intake portion formed in the cooking device body 1, and thereby pushing out the inside air from the chamber. The air outlet portion 10 has an air outlet duct 11 connected to a side wall 3*a* of the heating chamber 3 and a lower side portion 12 of a front wall 1*a* of the cooking device body 1.

The air outlet duct 11 for discharging the inside air is a duct formed by utilizing the side wall 3*a* of the heating chamber 3, which is connected to the lower side area 12 of the front wall (front side panel) 1*a* of the cooking device body 1. The side wall (side face panel) 3*a* of the heating chamber 3 includes an air outlet port area (not shown) having a large number of outlet ports formed on the upper front side of the side wall 3*a*. The air outlet duct 11 is composed of a first duct portion 11*a* covering the outer side of the heating chamber 3 of the air outlet port area and extending laterally, and a second duct portion 11*b* disposed along the outer side of the side wall 3*a* downward to the lower side portion 12 of the front wall 1*a* of the cooking device body 1.

Since the inside air within the heating chamber 3 has high temperature, the air tends to gather at the upper area. Therefore, the air inside the heating chamber 3 is discharged through the large number of air outlet ports formed in the air outlet port area disposed on the upper front side of the side wall 3*a* into a first duct portion 11*a* of the air outlet duct 11, and the outlet air flow passes a second duct portion 11*b* and is discharged via an air outlet opening 13 formed to the lower side portion 12 of the front wall 1*a* of the cooking device body 1 to the exterior of the cooking device body. Therefore, the present arrangement does not require an air inlet and outlet duct structure composed of a thick duct disposed on the lower side of the heating chamber 3 as according to the prior art, so that the height of the heating chamber 3 can be increased correspondingly.

An air outlet opening 13 of the air outlet duct 11 is formed on the lower side portion 12 of the front wall 1*a* of the cooking device body 1, and when the door 2*a* is stored to shut the front side opening 3*a* of the heating chamber 3, the air outlet opening 13 is hidden from the front side by the door 2*a*. As described, since the air outlet opening 13 of the air outlet duct 11 is hidden from the front side by the door 2*a* when the door 2*a* is closed, the air outlet that had been visible according to the prior art device is no longer visible from the front side, and the exterior design of the present built-in cooking device is advantageously simplified. When the door 2*a* is closed, the air outlet opening 13 is simply hidden but not closed, so that the outlet air flow will not be interfered.

The air outlet opening 13 of the air outlet duct 11 is disposed close to the left or right end in the width direction of the lower side portion 12 of the front wall 1*a* of the cooking device body 1. The flow of inside air within the heating chamber 3 is a flow headed toward the air outlet port area disposed on one side wall 3*a*, so that the air outlet opening 13 of the air outlet duct 11 should only be disposed close to the width-direction-end on one side where the air outlet port area 3*b* is disposed.

Figure 4:
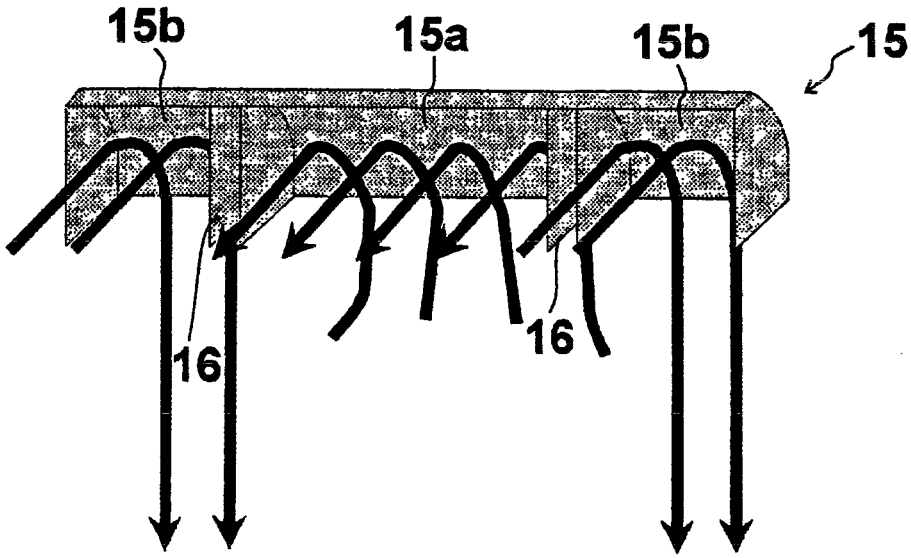
FIG. 4 is a perspective view showing the air guide portion formed to a lower end edge of a door frame in the built-in cooking device according to the present invention.

As shown in FIG. 4, it is possible to form on the inner side of the door 2*a* an air guide (air inlet and outlet) portion 15 formed with an angle of approximately 90 degrees toward the heating chamber and toward the lower side of the door on the lower end rim portion of the door frame corresponding to the range of the air outlet opening 13 of the air outlet duct 11, so as to mutually bend the direction of air flows passing therethrough. By adopting a door frame having the lower end of the door functioning as an air guide portion 15, it becomes possible to eliminate the air inlet and outlet louver (visible from the exterior) disposed on the lower front side of the prior art cooking device body, which not only leads to cutting down the costs but also to improving the exterior design since the air inlet and outlet portion can be hidden from the eyes of the user and only the front side of the door becomes visible. In FIG. 4, element 16 shows the partitions On the inner side of the door 2*a* are formed partition portions 16 for guiding the outlet air flow from the air outlet opening 13 of the air outlet duct 11 in correspondence to the left and right boundaries of the air outlet opening 13 of the air outlet duct 11. The partition portions 16 can be formed integrally, for example, when molding a resin product constituting the inner wall component of the door 2*a*. By forming partition portions 16, a portion of the lower area of the door 2*a* functions as an outlet air guide on the outer side of the chamber (air outlet portion 15*b*; refer to FIG. 4), and the air flow discharged through the air outlet opening 13 of the air outlet duct 11 is guided along the partition portions 16 desirably downward from the lower area of the front side of the door 2*a*. The downward outlet air flow blown down from the air outlet portion 15*b* will reach the area near the floor surface by wind speed, where the wind speed is lost and the air is dispersed horizontally, so that hot outlet air flow can be prevented from directly hitting the user's body from waist to knee.

As described, the left and right ends of the air guide portion 15 is an outlet air guide (air outlet portion 15*b*) communicated with the air outlet opening 13, but the center area of the air guide portion 15 is an air intake guide (air intake portion 15*a*) communicated with the air intake portion disposed on the cooking device body 1. According to the present arrangement, since the air relatively close to room temperature at a height close to the lower area of the door is taken in through the air intake guide, it becomes possible to prevent the outlet air flow that reaches the floor surface and spreads horizontally from being sucked in directly and causing short circuit. In other words, outlet air is assumed to be sent out from the cooking device body 1 to the door 2*a* via the air blow fan, where the flow direction is biased downward via the air outlet portion 15*b*, so that the outlet air flows with a downward directional quality with a certain flow speed. The outlet air flow directed downward is a gas having a varied density since the temperature thereof differs from outer air, and since it has a downward directional quality, it reaches the floor surface as a continuous air flow without easily mixing with outer air. On the other hand, since the intake air does not have such directional quality regardless of speed, so that outer air close to the air outlet opening 13 is taken in. As described, the air flows of the inlet and outlet air pass the air inlet and outlet portion 15 having the same shape, but since the flow paths of the inlet and outlet air are asymmetric, and the inlet and outlet air are discriminated hydrodynamically, a short circuit phenomenon at the air inlet and outlet portion 15 where the outlet air is directly sucked in again can be significantly reduced.

A portion of the air having cooled the electric components disposed at the depth portion of the heating chamber is elevated using the air pressure at the marginal portion of the air blow current of the cooling fan, so as to flow through the upper side of the ceiling panel to thereby cool the ceiling panel. Then, the air heated to high temperature (not containing vapor) is flown naturally using a natural convention current effect through the space between the cooking device body 1 and the ceiling panel of the heating chamber, passed through the clearance formed to the front side panel 1*a* of the cooking device body 1 to be discharged through the clearance formed between the control panel 5 and the door 2*a*. According to such air outlet current, the rising of temperature of the upper portion of the cooking device is moderated, the reliability of the control unit is improved, and the high-humidity hot air generated in the heating chamber 3 can be prevented from entering due to the wind pressure of the air blow current, so that the heating and moistening of the ceiling panel of the casing can be prevented simultaneously. Further, since the portion (ceiling panel) that had not been cooled by air according to the prior art structure is cooled according to the present invention, the overall cooling efficiency of the cooking device is improved.

By adopting the above-described arrangement, the present invention has enabled to eliminate the air inlet and outlet duct structure with a thick duct disposed below the heating chamber, so that the built-in cooking device according to the present invention is structured so that the interior structural body such as the heating chamber is engaged either directly or via an engagement means having high rigidity to the bottom face panel. This is effective in improving the mechanical strength of the built-in cooking device throughout the product shipping state, from the manufacturing of the product in a factory and packaging to the built-in installation process.

In other words, the standards related to product design require that the interior of the device is not damaged when the device is dropped in the packaged state, assuming a case where the device is dropped from the back of a truck to a road surface during transportation, but according to the prior art cooking device having an inlet and outlet duct structure with a thick duct disposed on the bottom of the heating chamber 3, the air inlet and outlet structure may be deformed by the shock caused by the drop, so that it was necessary to adopt a duct structure capable of enduring a stress significantly greater than the stress applied during actual use, according to which both the costs and the weight of the device were increased.

Furthermore, even if the stress applied to the air inlet and outlet duct structure during the drop test was within the elastic limit of the steel panels constituting the air inlet and outlet duct, and that plastic deformation does not occur since the duct is deformed temporarily but restores its original shape by repulsion, a stress in the opposite direction as the stress applied during the drop test of a normal cooking device is applied during the repulsive restoration. Therefore, it is necessary to consider such stress in the opposite direction when designing the portions adjacent to the air inlet and outlet duct structure, and for example, the methods and positions for mounting weight members such as the high pressure transformer had been restricted according to the prior art. On the other hand, according to the structure disclosed in the preferred embodiment of the present invention, the inner structural body such as the heating chamber is engaged either directly or via an engagement means having a high rigidity to the bottom face panel, so that there is no need to consider the above-described stress applied in the opposite direction during repulsive restoration, and the costs of the relevant portions could be cut down.

As described, according to the structure disclosed in the preferred embodiment of the present invention, it is possible not only possible to solve the design problems according to the prior art built-in cooking device caused by having the air inlet and outlet duct structure with a thick duct disposed on the lower side of the heating chamber, and to realize the reduction of product costs and weight, but also to realize an indirect design improvement effect due to the improvement of the method and the position for mounting the heavy weight component in the interior of the device.

What is claimed is:

1. A built-in cooking device comprising:

a cooking device body configured to be built into a cabinet and having in an interior thereof a heating chamber capable of storing an object to be cooked, said cooking device having a front side, said front side having a lower portion;

a door capable of closing a front side opening of the heating chamber; and an air-inlet-and-outlet portion having an air inlet portion for taking in cooling air to be sent into the heating chamber and an air outlet portion for discharging an inside air containing heat and vapor generated during cooking of the object to be cooked from the heating chamber;

wherein the door has a size large enough to cover the front side of the cooking device body including a lower portion thereof, and wherein the air-inlet-and-outlet portion is recessed at an inner lower side portion facing the lower portion of the cooking device body;

a partition separating the air inlet portion and the air outlet portion; and the direction of inlet air and outlet air flowing in the forward and rearward directions through the recessed portion of the door is changed to a perpendicular direction.

2. The built-in cooking device according to claim 1, wherein a clearance functioning as an air outlet path is formed between an upper front end of the cooking device body and an upper portion of the door, the clearance is configured to release air retained at an upper portion of the cooking device to the exterior.

3. The built-in cooking device according to claim 1, further comprising an air inlet wall portion having a plurality of holes formed on a rear wall of the heating chamber, wherein the air having been taken in through the air inlet portion and having cooled a magnetron for generating microwave for cooking is introduced through the air inlet wall portion into the heating chamber.

4. The built-in cooking device according to claim 2, further comprising an air inlet wall portion having a plurality of holes formed on a rear wall of the heating chamber, wherein the air having been taken in through the air inlet portion and having cooled a magnetron for generating microwave for cooking is introduced through the air inlet wall portion into the heating chamber.

* * * * *